US009000662B2

(12) United States Patent
Liu et al.

(10) Patent No.: US 9,000,662 B2
(45) Date of Patent: Apr. 7, 2015

(54) FIELD EMISSION DEVICE AND FIELD EMISSION DISPLAY HAVING SAME

(71) Applicants: Peng Liu, Beijing (CN); Shou-Shan Fan, Beijing (CN); Yang Wei, Beijing (CN)

(72) Inventors: Peng Liu, Beijing (CN); Shou-Shan Fan, Beijing (CN); Yang Wei, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 287 days.

(21) Appl. No.: 13/630,255

(22) Filed: Sep. 28, 2012

(65) Prior Publication Data

US 2013/0082588 A1 Apr. 4, 2013

(30) Foreign Application Priority Data

Sep. 30, 2011 (CN) ..... 2011 1 0296578

(51) Int. Cl.

| | |
|---|---|
| ***H05B 33/02*** | (2006.01) |
| ***H01J 3/02*** | (2006.01) |
| ***H01J 29/46*** | (2006.01) |
| ***H01J 31/12*** | (2006.01) |

(52) U.S. Cl.

CPC ..... *H01J 3/021* (2013.01); *H01J 29/467* (2013.01); *H01J 31/127* (2013.01); *H01J 2329/463* (2013.01)

(58) Field of Classification Search

None

See application file for complete search history.

(56) References Cited

U.S. PATENT DOCUMENTS

| | | | | |
|---|---|---|---|---|
| 2006/0103288 | A1 | 5/2006 | Sheng et al. | |
| 2008/0007154 | A1* | 1/2008 | Wei et al. | 313/497 |
| 2009/0115305 | A1* | 5/2009 | Segal et al. | 313/300 |
| 2011/0101845 | A1 | 5/2011 | Hao et al. | |

FOREIGN PATENT DOCUMENTS

| | | |
|---|---|---|
| TW | 200616000 | 5/2006 |
| TW | 201123250 | 7/2011 |

* cited by examiner

*Primary Examiner* — Ashok Patel

(74) *Attorney, Agent, or Firm* — Novak Druce Connolly Bove + Quigg LLP

(57) ABSTRACT

A field emission device includes a cathode and a carbon nanotube (CNT) gate electrode. The CNT gate electrode which is electrically insulated from the cathode includes a CNT layer and a dielectric layer. The CNT layer which has a surface includes a number of micropores. The dielectric layer is coated on the surface of the CNT layer and an inner wall of each of the micropores.

20 Claims, 9 Drawing Sheets

FIELD EMISSION DEVICE AND FIELD EMISSION DISPLAY HAVING SAME

CROSS-REFERENCE TO RELATED APPLICATIONS

This application claims all benefits accruing under 35 U.S.C. §119 from China Patent Application No. 201110296578.2, filed on Sep. 30, 2011 in the China Intellectual Property Office, disclosure of which is incorporated herein by reference.

BACKGROUND

1. Technical Field

The present disclosure relates to a field emission device including a carbon nanotube (CNT) gate electrode with a number of micropores allowing electrons to pass through, and a field emission display having the field emission device.

2. Description of Related Art

Field emission displays do not need additional backlight; therefore, the field emission display devices have high brightness, low power consumption, and fast response speed.

A conventional triode field emission display generally comprises at least one anode, at least one cathode, and a gate electrode between the anode and the cathode. The gate electrode provides an electrical potential to extract electrons from the cathode. The anode provides an electrical potential to accelerate the extracted electrons to bombard the anode for luminance.

The above-mentioned gate electrode is fabricated by a photolithography process and a corrosion process. The metal mesh includes a number of micropores through which electrons can pass. As the gate electrode is applied with electric signals, the electrons are extracted from at least one tip of the cathode. The metal mesh made of conductive plates or conductive material is extensively applied to the triode field emission display because the manufacturing process for the metal mesh is simple.

However, the electrical potential provided by the anode may infiltrate to a surface of the cathode if the dimensions of the micropores are too great. On the other hand, if the dimensions of the micropores are too small, it is difficult for the electrons to pass through the gate electrode due to its thickness of several to tens of mictons.

Thus, there remains a need for providing a novel gate electrode which could restrain infiltration of the electrical potential provided by the anode, allow a great amount of electrons to pass through, and have fast response.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
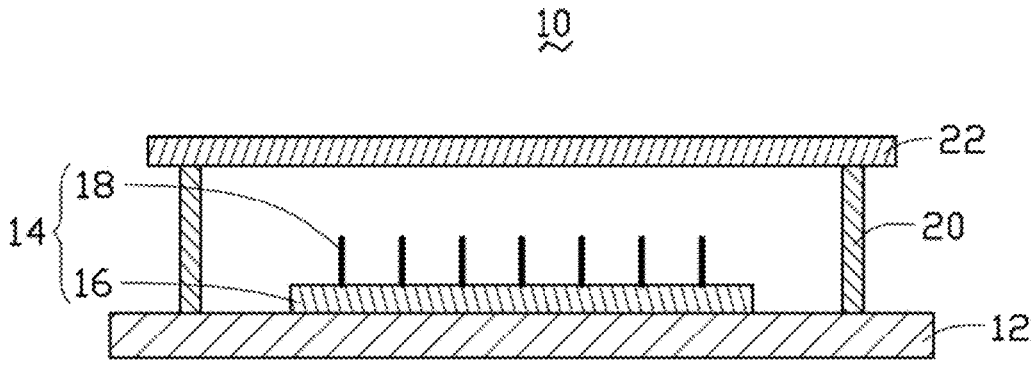
FIG. 1 is a partial cross-sectional view of one embodiment of a field emission device.

According to one embodiment, a field emission device 10 for a field emission display as illustrated in FIG. 1 includes an insulating substrate 12, a cathode 14, a number of spaces 20, and a CNT gate electrode 22. The cathode 14 includes a conductive layer 16 and a number of emitters 18. The conductive layer 16 of the cathode 14 and the spaces 20 are disposed on the insulating substrate 12. A shape of the insulating substrate 12 can be circular, square, rectangular, hexagonal, or polygonal. The insulating substrate 12 can be glass, porcelain, silica, ceramic, or any combination thereof. In one embodiment, the insulating substrate 12 is a porcelain substrate.

The cathode 14 can be a cold cathode or a hot cathode. In one embodiment, the cathode 14 is a cold cathode. The conductive layer 16 is disposed on the insulating substrate 12. The emitters 18 are substantially perpendicularly disposed on the conductive layer 16 with a regular interval. Thus, the emitters 18 are electrically connected to the conductive layer 16. The conductive layer 16 can be metal, alloy, indium tin oxide (ITO), conductive material, or any combination thereof. The emitters 18 can be metal tips or carbon nanotubes. In one embodiment, the conductive layer 16 is a rectangular ITO film. The emitters 18 are carbon nanotubes.

The spaces 20 are disposed on the insulating substrate 12 for supporting the CNT gate electrode 22. In other words, the CNT gate electrode 22 is electrically insulated from the cathode 14 due to the support of the spaces 20. The spaces 20 can be glass, porcelain, silica, ceramic, or any combination thereof. In one embodiment, there are two glass spaces 20 respectively disposed at two sides of the cathode 14.

Figure 2:
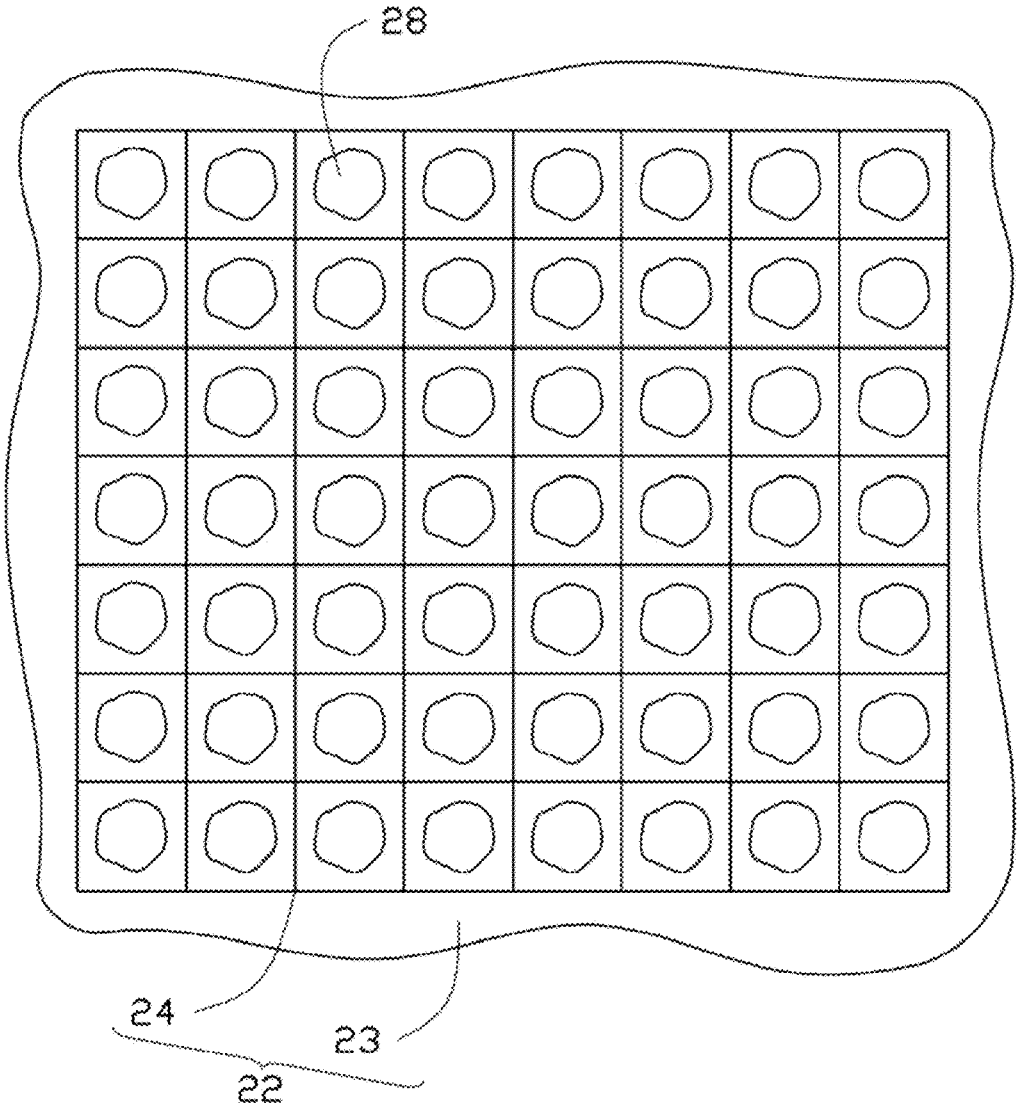
FIGS. 2 and 3 show schematic views of different embodiments of the CNT gate electrodes of the field emission device shown in FIG. 1.
Figure 3:
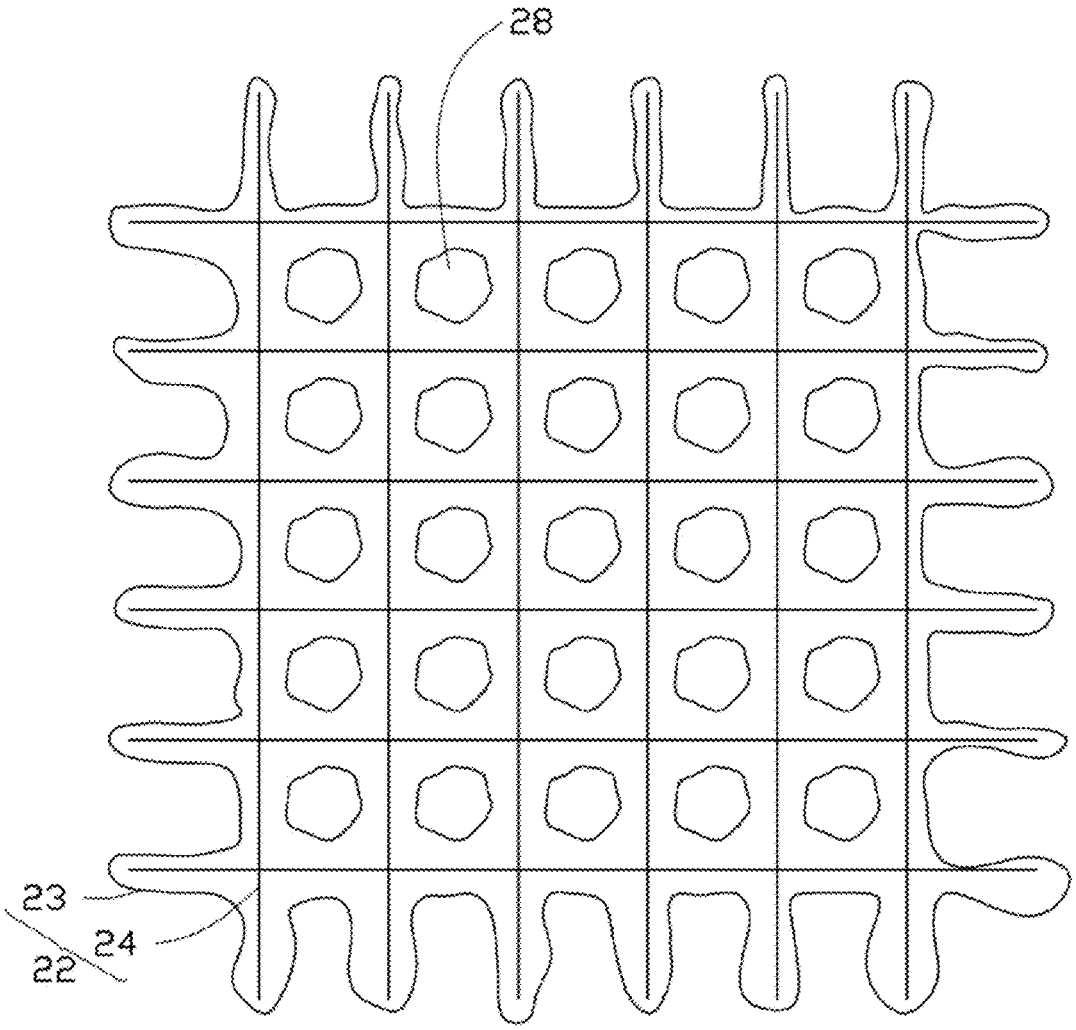

Referring to FIG. 2 and FIG. 3, the CNT gate electrode 22 includes a dielectric layer 23 and a CNT layer 24. The CNT layer 24 includes a number of micropores 28. Each of the micropores 28 includes an inner wall. The dielectric layer 23 is coated on a surface of the CNT layer 24 and the inner walls of micropores 28. A thickness of the CNT gate electrode 22 is in a range from about 10 nanometers (nm) to about 500 micrometers (μm). In one embodiment, the thickness of the CNT gate electrode 22 is about 100 nm.

The dielectric layer 23 can be diamond-like carbon, silicon, silicon dioxide, silicon carbide, boron nitride, silicon nitride, aluminum oxide, and any combination thereof. A thickness of the dielectric layer 23 is in a range from about 1 nm to about 100 μm. In one embodiment, the dielectric layer 23 is a diamond-like carbon layer. The thickness of the dielectric layer 23 is in a range from about 5 nm to about 100 nm The CNT layer 24 includes a number of carbon nanotubes capable of forming a free-standing structure. The term "free-standing structure" can be defined as a structure that does not need to be supported by a substrate. For example, a free-standing structure can sustain the weight of itself if the free-standing structure is hoisted by a portion thereof without any significant damage to its structural integrity. The carbon nanotubes can have a significant van der Waals force therebetween. The free-standing structure of the CNT layer 24 is realized by the carbon nanotubes joined by van der Waals force. The carbon nanotubes in the CNT layer 24 can be single-walled, double-walled, and/or multi-walled carbon nanotubes.

Figure 4:
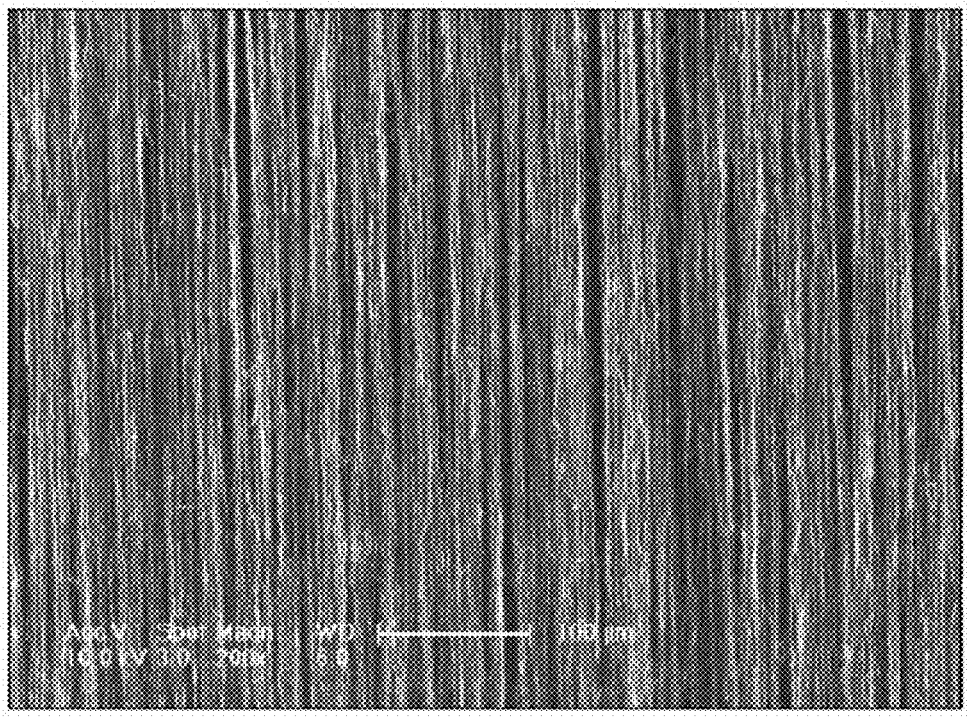
FIG. 4 shows a scanning electron microscope (SEM) image of one embodiment of a carbon nanotube film.

In one embodiment, the CNT layer 24 includes a drawn carbon nanotube film as shown in FIG. 4. The drawn carbon nanotube film can have a thickness of about 0.5 nm to about 100 μm. The drawn carbon nanotube film includes a number of carbon nanotubes that can be arranged substantially parallel to the surface of the CNT layer 24. The micropores 28 having a size of about 1 nm to about 200 μm can be defined by the carbon nanotubes. A large number of the carbon nanotubes in the drawn carbon nanotube film can be oriented along a preferred orientation, meaning that a large number of the carbon nanotubes in the drawn carbon nanotube film are arranged substantially along the same direction. An end of one carbon nanotube is joined to another end of an adjacent carbon nanotube arranged substantially along the same direction, by van der Waals force. The drawn carbon nanotube film includes a number of successively oriented carbon nanotube segments joined end-to-end by van der Waals force therebetween. Each carbon nanotube segment includes a number of carbon nanotubes substantially parallel to each other and joined by van der Waals force therebetween. The carbon nanotube segments can vary in width, thickness, uniformity, and shape. A small number of the carbon nanotubes are randomly arranged in the drawn carbon nanotube film.

Figure 5:
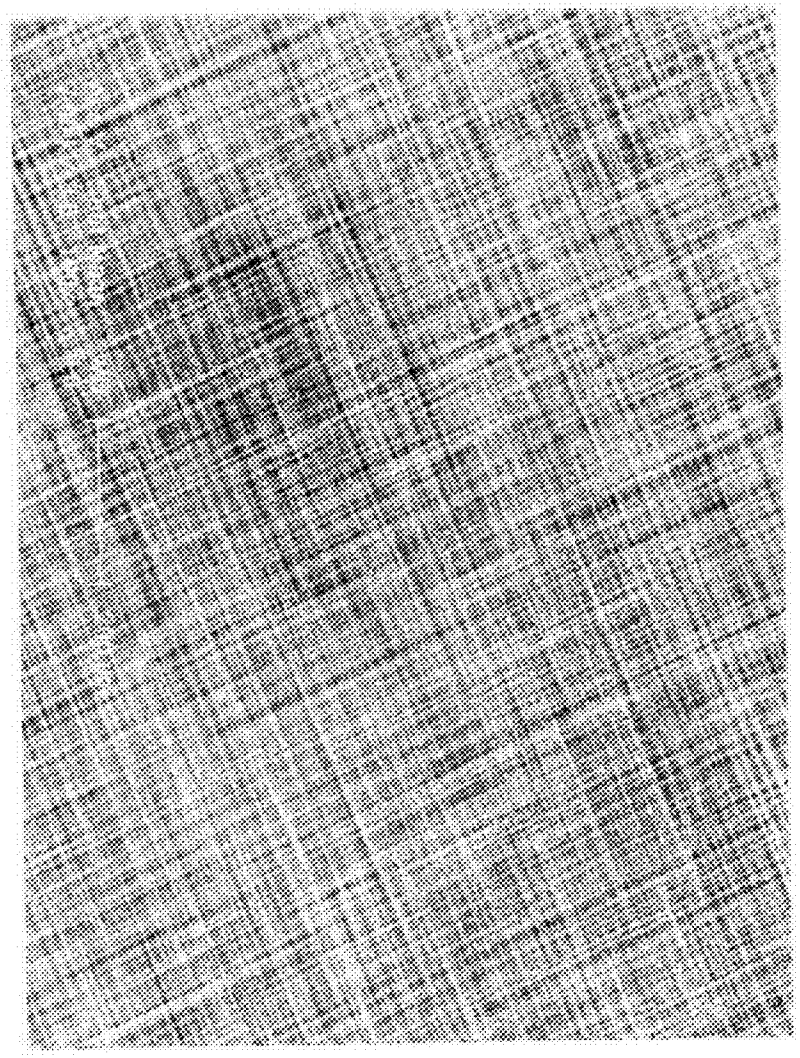
FIG. 5 shows an SEM image of a number of stacked carbon nanotube films.

In another embodiment, the CNT layer 24 can include a number of stacked drawn carbon nanotube films as shown in FIG. 5. Adjacent drawn carbon nanotube films can be adhered by the van der Waals force therebetween. An angle can exist between the carbon nanotubes in adjacent drawn carbon nanotube films. The angle between the aligned directions of the adjacent drawn carbon nanotube films can be equal to or smaller than 90 degrees. Specifically, the CNT layer 24 includes a number of first carbon nanotubes and a number of second carbon nanotubes arranged substantially parallel to the surface of the CNT layer 24. The first carbon nanotubes are arranged successively along the first preferred orientation direction and are joined end-to-end along a first preferred orientation direction by van der Waals force therebetween. Similarly, the second carbon nanotubes are arranged successively along a second preferred orientation direction and are joined end-to-end along the second preferred orientation direction by van der Waals force therebetween. An angle between the first and the second preferred orientation directions can be equal to or smaller than 90 degrees.

Figure 6:
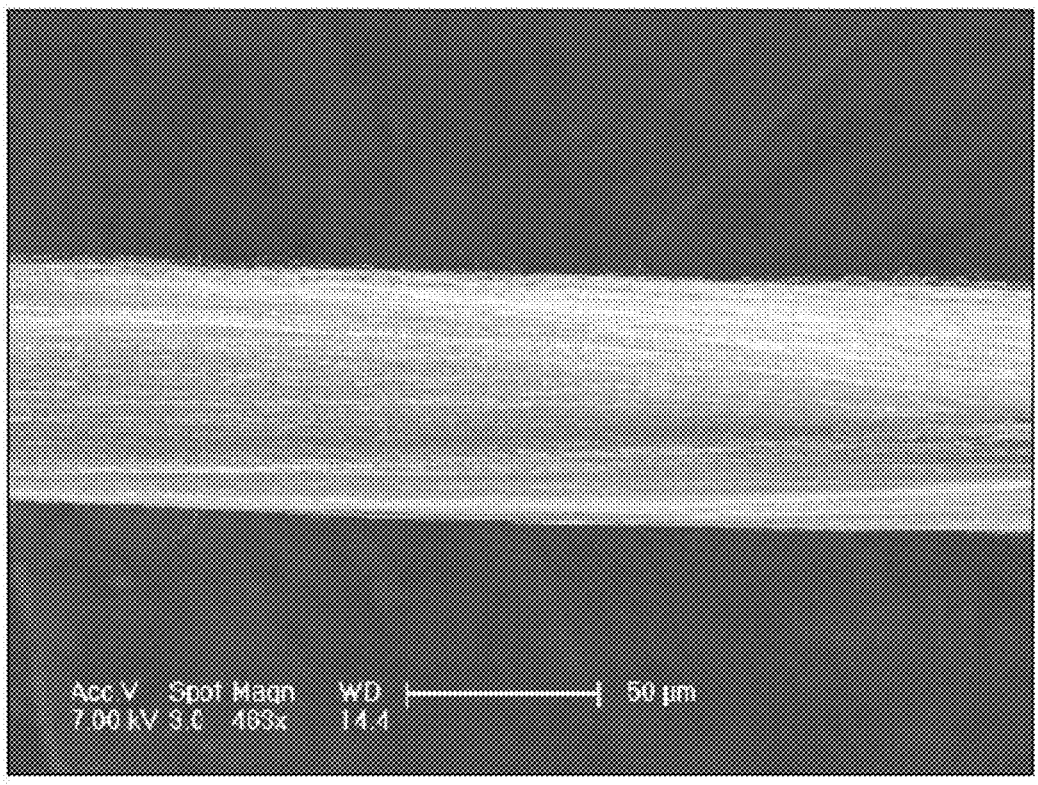
FIG. 6 shows an SEM image of an untwisted carbon nanotube wire.

Alternatively, the CNT layer 24 can be formed by a number of carbon nanotube wires. Thus, one portion of the carbon nanotube wires is arranged substantially parallel to each other and extends substantially along a first direction. In addition, the other portion of the carbon nanotube wires is arranged substantially parallel to each other and extends substantially along a second direction. The first direction and the second direction can be substantially perpendicular to each other. In one embodiment, the carbon nanotube wire can be classified as untwisted carbon nanotube wire and twisted carbon nanotube wire. Referring to FIG. 6, the untwisted carbon nanotube wire is made by treating the carbon nanotude film described above with an organic solvent. In such case, the carbon nanotubes of the untwisted carbon nanotube wire are substantially parallel to the axis of the carbon nanotube wire. In one embodiment, the organic solvent can be ethanol, methanol, acetone, dichloroethane, or chloroform. The diameter of the untwisted carbon nanotube wire is in a range from about 0.5 nm to about 100 μm.

Figure 7:
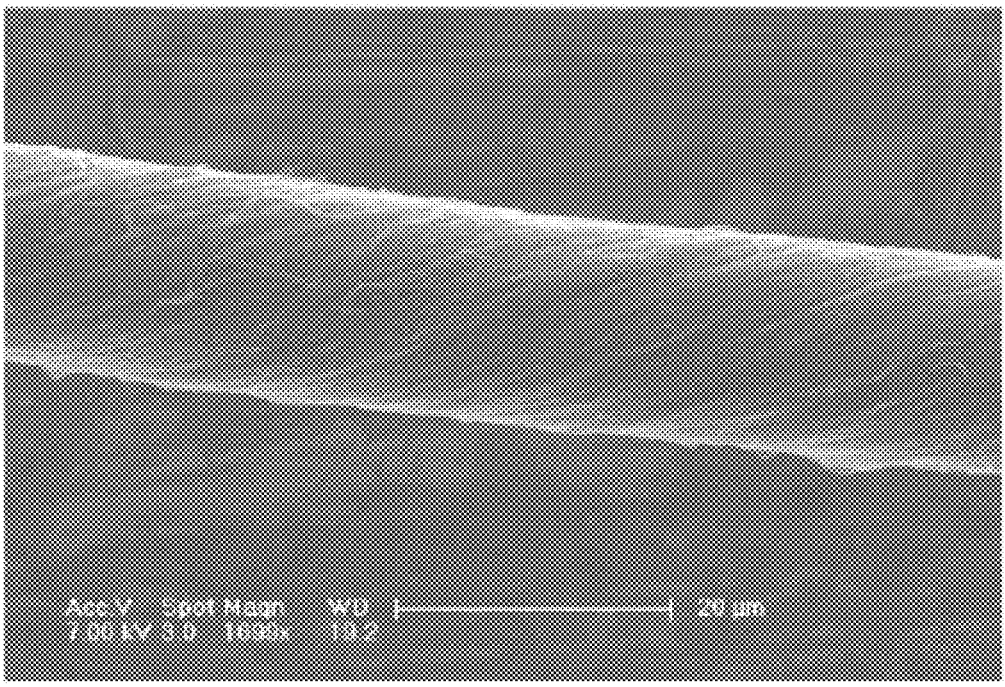
FIG. 7 shows an SEM image of a twisted carbon nanotube wire.

Furthermore, referring to FIG. 7, the carbon nanotube wire can be formed by twisting the carbon nanotube film to form the twisted carbon nanotube wire. Specifically, twisted carbon nanotube wire is formed by turning two opposite ends of the carbon nanotube film in opposite directions. Afterward, the twisted carbon nanotube wire can be treated with an organic solvent. In one embodiment, the organic solvent can be ethanol, methanol, acetone, dichloroethane, or chloroform. The carbon nanotubes of the treated twisted carbon nanotube wire are aligned around the axis of the carbon nanotube spirally. The diameter of the twisted carbon nanotube wire is in a range from about 0.5 nm to about 100 μm.

Figure 8:
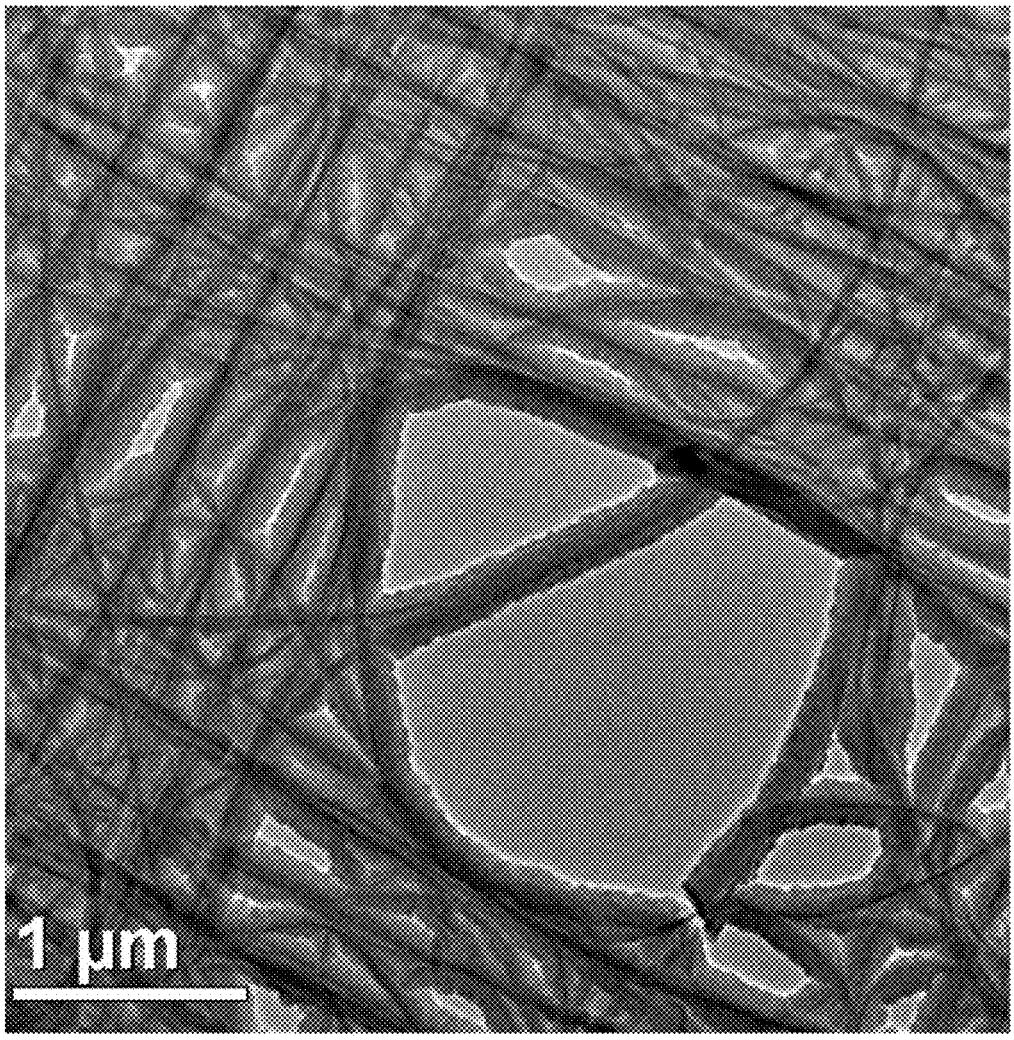
FIG. 8 shows a transmission electron microscope (TEM) image of a partial enlarged view of the stacked carbon nanotube films shown in FIG. 5.

In one embodiment, referring to FIG. 8, the CNT layer 24 is formed by two layers of drawn carbon nanotube films. The angle between the aligned directions of the adjacent drawn carbon nanotube films is about 90 degrees. Simultaneously, aligned directions of adjacent drawn carbon nanotube films can be substantially perpendicular to each other.

Figure 9:
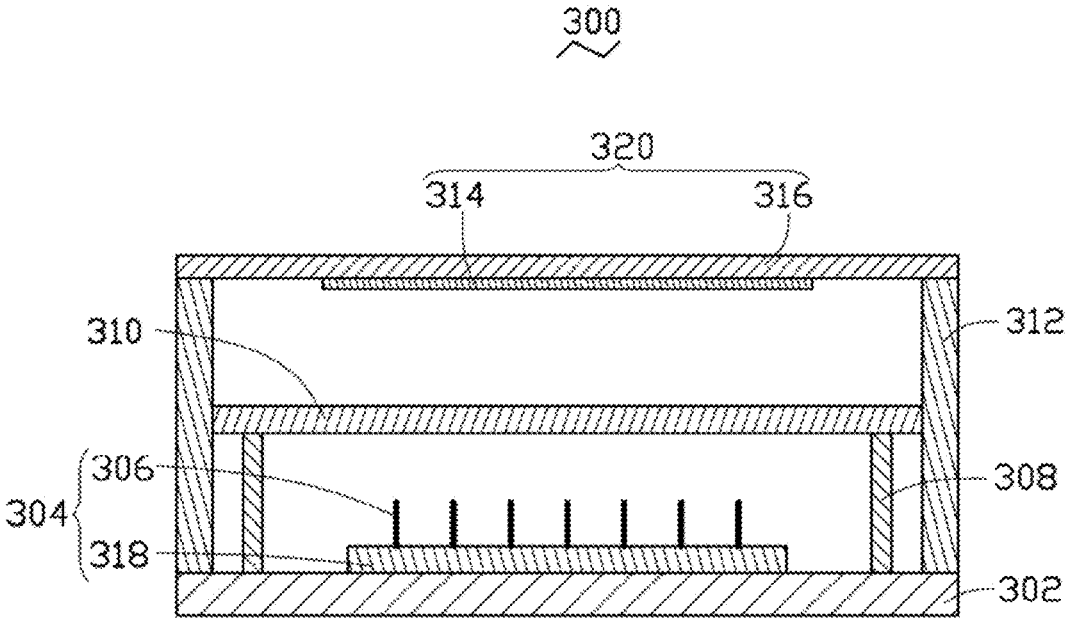
FIG. 9 is a cross-sectional view of one embodiment of a field emission display.

According to one embodiment, a field emission display 300 as illustrated in FIG. 9 includes an insulating substrate 302, a cathode 304, a number of first spaces 308, a CNT gate electrode 310, a number of second spaces 312, and an anode substrate 320. The cathode 304 includes a conductive layer 318 and a number of emitters 306. The anode substrate 320 includes an anode 314 and a fluorescent layer 316. The insulating substrate 102, the anode substrate 320, and the second spacers 312 cooperatively define a cavity. The cathode 304, the first spaces 308, the CNT gate electrode 310, and the anode 314 are disposed in the cavity. The second spaces 312 are disposed on the insulating substrate 302 for supporting the anode substrate 320. The fluorescent layer 316 is disposed on a surface of the anode 314.

In one embodiment, the cathode 304 generates a number of electrons (not shown), and the anode 314 provides an electrical potential to accelerate the electrons to bombard the fluorescent layer 316 for luminance.

The conductive layer 318 of the cathode 304 and the first spaces 308 are disposed on the insulating substrate 302. A shape of the insulating substrate 302 can be circular, square, rectangular, hexagonal, or polygonal. The insulating substrate 302 can be glass, porcelain, silica, ceramic, or any combination thereof. In one embodiment, the insulating substrate 302 is a porcelain substrate.

The cathode 304 can be a cold cathode or a hot cathode. In one embodiment, the cathode 304 is a cold cathode. The conductive layer 318 is disposed on the insulating substrate 302. The emitters 306 are substantially perpendicularly disposed on the conductive layer 318 with a regular interval. Thus, the emitters 306 are electrically connected to the conductive layer 318. The conductive layer 318 can be metal, alloy, ITO, conductive material, or any combination thereof. The emitters 306 can be metal tips or carbon nanotubes. In one embodiment, the conductive layer 318 is a rectangular ITO film. The emitters 306 are carbon nanotubes.

The first spaces 308 are disposed on the insulating substrate 302 for supporting the CNT gate electrode 310. In other words, the CNT gate electrode 310 is electrically insulated from the cathode 304 due to the support of the first spaces 308.

The first spaces 308 can be glass, porcelain, silica, ceramic, or any combination thereof. In one embodiment, the first spaces 308 are glass spacers.

The anode 314 can be metal, alloy, ITO, conductive material, or any combination thereof. A shape of the anode 314 can be square or rectangular. In one embodiment, the anode 314 is rectangular ITO glass.

Accordingly, the present disclosure is capable of providing an emission device with a CNT gate electrode which has a CNT layer and a number of micropores. Furthermore, a dielectric layer is coated on a surface of the CNT layer and inner walls of the micropores. Thus, an electrical potential provided by an anode can be efficiently restrained, and the response of the field emission device is increased It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

What is claimed is:

1. A field emission device comprising a cathode in contact with a surface of an insulating substrate and a carbon nanotube (CNT) gate electrode electrically insulated from the cathode, the CNT gate electrode comprising:

a CNT layer having a surface; and a dielectric layer coated on the surface of the CNT layer.

2. The field emission device as claimed in claim 1, wherein a material of the dielectric layer is selected from the group consisting of diamond-like carbon, silicon, silicon dioxide, silicon carbide, boron nitride, silicon nitride, aluminum oxide, and any combination thereof.

3. The field emission device as claimed in claim 1, wherein a thickness of the dielectric layer is in a range from about 1 nanometer to about 100 micrometers.

4. The field emission device as claimed in claim 1, wherein the CNT layer comprises a plurality of carbon nanotubes arranged substantially parallel to the surface of the CNT layer.

5. The field emission device as claimed in claim 4, wherein each of the plurality of carbon nanotubes defines a preferred orientation direction, and the plurality of carbon nanotubes are arranged successively along the preferred orientation direction and are joined end-to-end along the preferred orientation direction by van der Waals force therebetween.

6. The field emission device as claimed in claim 1, wherein the CNT layer comprises a plurality of first carbon nanotubes and a plurality of second carbon nanotubes arranged substantially parallel to the surface of the CNT layer, each of the plurality of first carbon nanotubes defines a first preferred orientation direction, the plurality of first carbon nanotubes are arranged successively along the first preferred orientation direction, each of the plurality of second carbon nanotubes defines a second preferred orientation direction, the plurality of second carbon nanotubes are arranged successively along the second preferred orientation direction, and an angle between the first and the second preferred orientation directions is equal to or smaller than 90 degrees.

7. The field emission device as claimed in claim 1, wherein the CNT layer comprises a plurality of carbon nanotube films stacked together, and adjacent carbon nanotube films are combined and attracted to each other.

8. The field emission device as claimed in claim 7, wherein each of the plurality of carbon nanotube films comprises a plurality of carbon nanotubes orientated in one direction, and an angle between the orientations of carbon nanotubes in two adjacent carbon nanotube films of the plurality of carbon nanotube films is equal to or smaller than 90 degrees.

9. The field emission device as claimed in claim 1, wherein the CNT layer comprises at least one untwisted carbon nanotube wire comprising a plurality of carbon nanotubes arranged substantially parallel to an axis of the at least one untwisted carbon nanotube wire.

10. The field emission device as claimed in claim 1, wherein the CNT layer comprises at least one twisted carbon nanotube wire comprising a plurality of carbon nanotubes aligned around an axis of the at least one twisted carbon nanotube wire spirally.

11. A field emission device comprising a cathode and a CNT gate electrode electrically insulated from the cathode, the CNT gate electrode comprising:

a CNT layer having a surface; and a dielectric layer coated on the surface of the CNT layer, wherein the CNT layer comprises a plurality of micropores.

12. The field emission device as claimed in claim 11, wherein each of the plurality of micropores comprises an inner wall, the dielectric layer is coated on the inner wall of each of the plurality of micropores.

13. The field emission device as claimed in claim 11, wherein the CNT layer comprises a plurality of carbon nanotubes arranged substantially parallel to the surface of the CNT layer.

14. The field emission device as claimed in claim 13, wherein each of the plurality of carbon nanotubes defines a preferred orientation direction, and the plurality of carbon nanotubes are arranged successively along the preferred orientation direction and are joined end-to-end along the preferred orientation direction by van der Waals force therebetween.

15. A field emission display, comprising:

an anode substrate comprising an anode and a fluorescent layer disposed on a surface of the anode;

a plurality of spacers;

an insulating substrate; and a field emission device comprising a cathode in contact with a surface of the insulating substrate and a CNT gate electrode electrically insulated from the cathode, wherein the insulating substrate, the anode substrate, and the plurality of spacers cooperatively define a cavity, the field emission device and the anode are disposed in the cavity, and the CNT gate electrode comprises:

a CNT layer; and a dielectric layer coated on a surface of the CNT layer.

16. The field emission display as claimed in claim 15, wherein the CNT layer of the field emission device comprises a plurality of carbon nanotubes arranged substantially parallel to the surface of the CNT layer.

17. The field emission display as claimed in claim 16, wherein each of the plurality of carbon nanotubes defines a preferred orientation direction, and the plurality of carbon nanotubes are arranged successively along the preferred orientation direction and are joined end-to-end along the preferred orientation direction by van der Waals force therebetween.

18. The field emission display as claimed in claim 15, wherein the CNT layer of the field emission device comprises a plurality of carbon nanotube films stacked together, adjacent carbon nanotube films are combined and attracted to each other, each of the plurality of carbon nanotube films comprises a plurality of carbon nanotubes orientated in one direction, and an angle between the orientations of carbon nanotubes in two adjacent carbon nanotube films of the plurality of carbon nanotube films is equal to or smaller than 90 degree.

19. The field emission display as claimed in claim 15, wherein the CNT layer of the field emission device comprises at least one untwisted carbon nanotube wire comprising a plurality of carbon nanotubes arranged substantially parallel to an axis of the at least one untwisted carbon nanotube wire.

20. The field emission display as claimed in claim 15, wherein the CNT layer of the field emission device comprises at least one twisted carbon nanotube wire comprising a plurality of carbon nanotubes aligned around an axis of the at least one twisted carbon nanotube wire spirally.

* * * * *